United States Patent [19]

Pilling

[11] Patent Number: 5,060,930

[45] Date of Patent: Oct. 29, 1991

[54] APPARATUS FOR RECEIVING ARTICLES BY SELF-FEEDING AND FOR CONVEYING AND DISPENSING SUCH ARTICLES

[75] Inventor: Roger Pilling, Southampton, England

[73] Assignee: De La Rue Systems Limited, England

[21] Appl. No.: 485,444

[22] Filed: Feb. 27, 1990

[30] Foreign Application Priority Data

Feb. 28, 1989 [GB] United Kingdom ..... 8904569

[51] Int. Cl.[5] ..... B65H 5/02

[52] U.S. Cl. ..... 271/268; 271/277; 271/200; 271/73; 198/631

[58] Field of Search ..... 198/631, 343.1; 271/73, 271/198, 200, 267, 268, 272, 274, 275, 277

[56] References Cited

U.S. PATENT DOCUMENTS

| | | | |
|---|---|---|---|
| 3,411,773 | 11/1968 | Cornwall | 271/73 |
| 3,997,048 | 12/1976 | Hardy | 198/631 |
| 4,185,815 | 1/1980 | Abbott et al. | 271/73 |
| 4,530,591 | 7/1985 | Mastuyama | 271/267 |
| 4,553,660 | 11/1985 | Bennett et al. | 198/532 |
| 4,580,774 | 4/1986 | Yamaguchi et al. . | |
| 4,715,774 | 12/1987 | Magnuson | 271/268 |

FOREIGN PATENT DOCUMENTS

| | | |
|---|---|---|
| 307385 | 10/1917 | Fed. Rep. of Germany . |
| 2509519A1 | 9/1987 | Fed. Rep. of Germany . |
| 2310210 | 3/1976 | France . |
| 2198122A | 12/1986 | United Kingdom . |

*Primary Examiner*—Robert P. Olszewski
*Assistant Examiner*—Steve Reiss
*Attorney, Agent, or Firm*—Ostrolenk, Faber, Gerb & Soffen

[57] ABSTRACT

Article handling apparatus comprises a carriage mounted to a support for to and fro movement along a path (A). An article conveyor is mounted on the carriage defined by opposed conveying surfaces for conveying articles relative to the carriage along a transport path substantially parallel with the path of movement of the carriage relative to the support. First and second drives are provided for moving the carriage and actuating the article conveyor respectively, whereby in one operating mode, when the carriage is moved by the first drive, the second drive causes a compensatory movement of the article conveyor such that the opposed conveying surfaces defining the transport path remain substantially stationary. The carriage is movable to either of two dispense positions at opposite ends of the carriage path such that when the carriage is positioned at a dispense position articles held on the carriage may be dispensed by suitably opening the article conveyor.

5 Claims, 1 Drawing Sheet

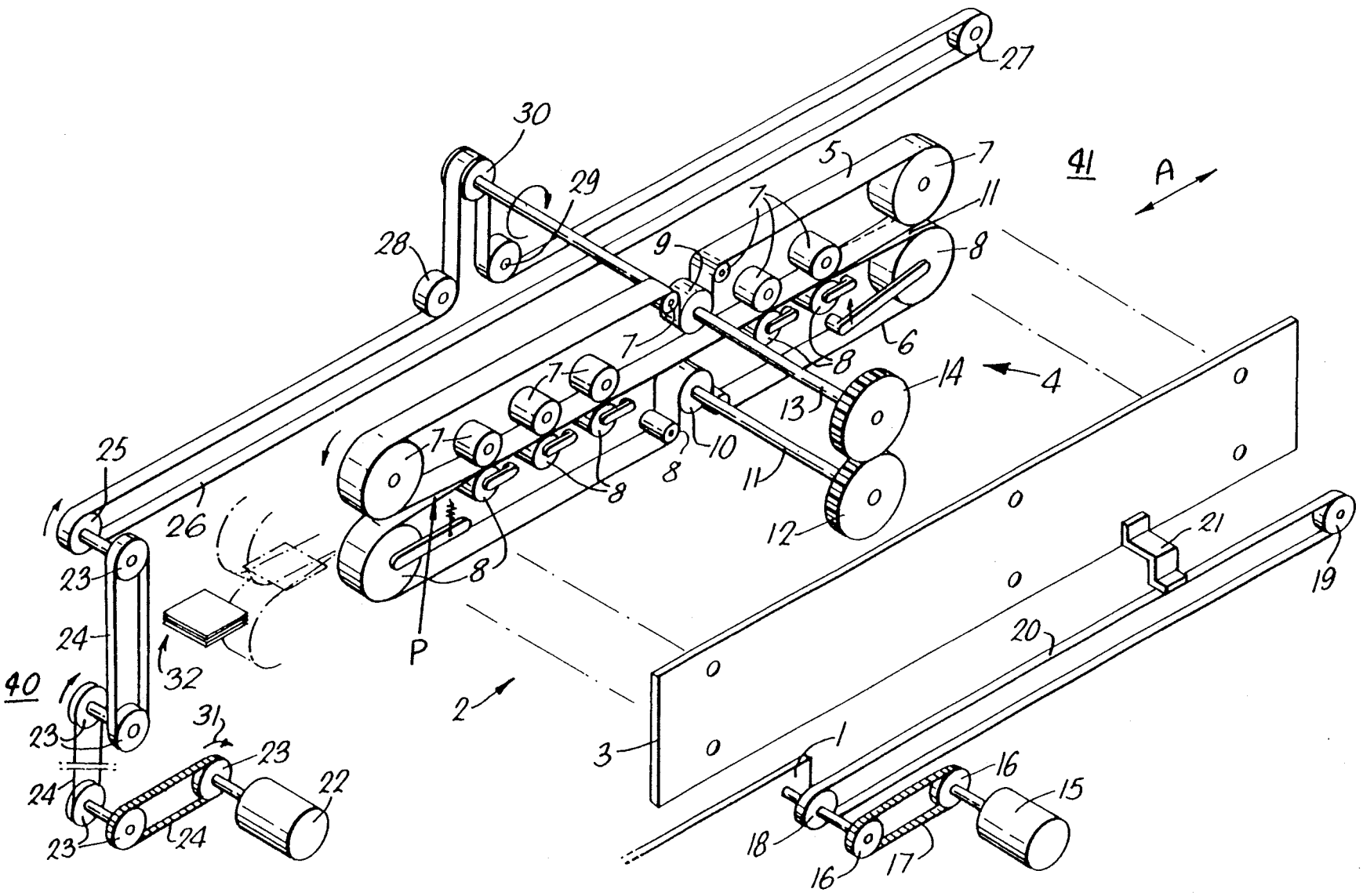
A
41
4
2
40
P

APPARATUS FOR RECEIVING ARTICLES BY SELF-FEEDING AND FOR CONVEYING AND DISPENSING SUCH ARTICLES

FIELD OF THE INVENTION

The invention relates to article handling apparatus.

DESCRIPTION OF THE PRIOR ART

Many types of apparatus exist for transporting articles such as sheets from one position to another. For example, sheet transport apparatus, such as banknote dispensing apparatus, usually involves a number of different transport systems for withdrawing sheets from stores and feeding them to a dispense outlet. In some of these types of apparatus, a stack of sheets is generated and in most cases this stack of sheets is generated at the dispense outlet from which it can simply be removed by the user. An example of such apparatus is described in U.S. Pat. No. 4580774. In some cases, however, there is requirement to generate a stack of sheets within the apparatus and then to convey the stack to a dispense outlet or to some other part of the apparatus such as a dump or further transport mechanism. It has proved to be particularly difficult satisfactorily to load a stack into a transport system since there is a tendency for sheets in the stack to scuff as the stack is moved into the system. This same problem of scuffing also occurs with single sheets.

SUMMARY OF THE INVENTION

In accordance with the present invention, article handling apparatus comprises a carriage mounted to a support for to and fro movement along a path; article conveying means mounted on the carriage defined by opposed conveying surfaces for conveying articles relative to the carriage along a transport path substantially parallel with the path of movement of the carriage relative to the support; and first and second drive means for moving the carriage and actuating the article conveying means respectively, whereby in one operating mode, when the carriage is moved by the first drive means, the second drive means causes a compensatory movement of the article conveying means such that the opposed conveying surfaces defining the transport path remain substantially stationary, and wherein the carriage is movable to either of two dispense positions at opposite ends of the carriage path such that when the carriage is positioned at a dispense position articles held on the carriage may be dispensed by suitably operating the article conveying means.

This invention not only avoids problems of scuffing by allowing the article conveying means to "self-feed" in a manner similar to caterpillar tracks onto a stationary article or stack of articles during movement of the carriage so that the article or stack of articles is firmly held by the opposed conveying surfaces before the article conveying means is actuated to convey the articles away from the loading position, but also enables the finished stack to be easily handled allowing it to be conveyed to either dispense position.

In one arrangement, the second drive means could be selectively actuated to cause the compensatory movement. However, it is preferable if the second drive means comprises first and second rotatable members which are coupled together such that rotation of the first member causes rotation of the second member, the second member being coupled with the article conveying means and being movable with the carriage relative to the first rotatable member, the first and second rotatable members being coupled together such that when the first rotatable member is prevented from rotating, the second rotatable member rotates upon movement of the carriage. With this arrangement, automatic compensatory movement of the article conveying means is achieved upon movement of the carriage without the need carefully to determine the degree of movement of the article conveying means needed to cause the opposed conveying surfaces to remain substantially stationary.

In the preferred example, the first and second rotatable members are coupled together by a belt, for example, a toothed belt.

Preferably, the article conveying means comprises a pair of opposed track assemblies.

In order to ensure a positive gripping of articles between the opposed surfaces, it is preferred that the opposed surfaces are urged together under spring action.

The invention is particularly useful for handling sheets such as banknotes.

BRIEF DESCRIPTION OF THE DRAWINGS

An example of article transport apparatus according to the invention will now be described with reference to the accompanying drawing which is a schematic, exploded view of the apparatus.

DETAILED DESCRIPTION OF AN EMBODIMENT

The apparatus comprises a support housing including main side plates 1 (part of one of which is shown in the drawing), the support housing supporting a carriage 2 by means not shown such that the carriage can move to and fro between the main side plates 1 in the directions A. The carriage comprises a pair of side plates 3 (one of which is shown in the drawing) suspended between the main side plates 1 with a sheet conveying system 4 mounted between the side plates 3.

The sheet conveying system 4 comprises a pair of belts 5, 6 entrained around idler rollers 7, 8 respectively and drive rollers 9, 10. The belts 5, 6 define a sheet feed path 11 with adjacent surfaces of the belts being urged together via the idler rollers 8 which are spring biased by means not shown towards the idler rollers 7.

The drive roller 10 is non-rotatably mounted to a shaft 11 carrying a drive gear 12, the shaft 11 being rotatably mounted between the carriage side plates 3. A second shaft 13 is also rotatably mounted between the carriage side plates 3 and carries non-rotatably a gear 14 which is meshed with the gear 12 and the drive roller 9.

A first drive system is provided for causing the to and fro movement of the carriage 2. This first drive system comprises a drive motor 15 coupled via pulleys 16 and a toothed drive belt 17 to a pulley 18 rotatably mounted to a side plate 1. A toothed drive belt 20 is entrained around the pulley 18 and another pulley 19 also mounted to the side plate 1 and carries a bracket 21 which is coupled with one of the carriage side plates 3 through a slot in the main side plate 1 (not shown).

Movement of the sheet conveying system 4 is controlled by a second drive system including a drive motor 22 coupled via pulleys 23 and belts 24 to a drive pulley 25 rotatably mounted to the side plate 1 opposite to that to which the first drive system is connected. A toothed belt 26 is entrained around the drive pulley 25 and around an idler wheel 27 rotatably mounted to the same side plate 1 as the drive wheel 25. In addition, the toothed drive belt 26 is entrained around pulleys 28, 29 rotatably mounted to a side plate 3 of the carriage and around a pulley 30 non-rotatably mounted to the shaft 13. The pitch circle diameter of the pulley 30 is the same of that of the pulley 9.

If the motor 15 is held stationary, actuation of the motor 22 in the direction of the arrow 31 will cause movement of the belts 5, 6 such that a sheet held at the point P between the belts will move to the right, as seen in the drawings.

With the motor 22 stopped and the motor 15 actuated, the carriage 2 will be moved to the right or to the left depending on the direction of rotation of the motor 15.

In operation, a previously formed stack of sheets is held stationary at a position 32 by means not shown. The stack of sheets may have been generated in any conventional manner but in the preferred apparatus has been generated by a system similar to that described in our copending US patent application claiming priority from British Patent Application No. 8904566.0 or GB-A-2193712. With the motor 22 held stationary and hence the pulley 25 stationary, the motor 15 is actuated to cause the carriage 2 to move to the left as seen in the drawing. This movement will cause the pulleys 28–30 mounted to the carriage to move to the left and hence rotate since the belt 26 is stationary. This will cause the shaft 13 to rotate and hence the belts 5, 6 will undergo a caterpillar track action such that both portions of the belts defining the feed path 11 will remain stationary and effectively the belts 5, 6 self-feed onto the stack 32. Since there is no relative, linear movement between the stack 32 and the belts 5, 6 the problem of scuffing will not occur.

Once the stack 32 is firmly gripped between the belts 5, 6 there is a choice of action which the apparatus can perform to deliver the stack. In one case, it may be designed to move the stack to the left, as seen in the drawing, to a dispense position 40 in which case the motor 15 is further actuated to cause the carriage 3 to move beyond the initial position of the stack 32 following which the motor 15 is stopped and the motor 22 actuated so that the belts 5, 6 are rotated to feed the stack to the dispense position 40.

In another case, once the stack 32 is firmly gripped between the belts 5, 6 it can be wound towards the right as seen in the drawing by rotation of the motor 22. The carriage 2 can now be advanced to the right by rotating motor 15 and thereafter the motor 22 can be rotated to feed the stack to the right to a dispense position 41. The stack of notes remains stationary when motor 15 rotates. The stack of notes and the carriage can only move in unison if the two motors are driven in unison, other progress has to be made in a series of steps related to the transport length of the carriage.

I claim:

1. Article handling apparatus comprising a carriage mounted to a support for to and fro movement along a path; article conveying means mounted on said carriage defined by opposed conveying surfaces for conveying articles relative to said carriage along a transport path substantially parallel with the path of movement of said carriage relative to said support, said opposed conveying surfaces defining article receiving openings at their ends; and first and second drive means for moving said carriage and actuating said article conveying means respectively, to an article receiving position, said second drive means causes a compensatory movement of said article conveying means such that said opposed conveying surfaces defining said transport path remain substantially stationary relative to one another and self-feed onto an article presented to one of said article receiving openings at said article receiving position, said carriage being movable to either of two dispense positions at opposite ends of said carriage path such that when said carriage is positioned at a dispense position articles held by said article conveying means on said carriage may be dispensed by operating said article conveying means to convey said articles to said dispense position.

2. Apparatus according to claim 1, wherein said second drive means comprises first and second rotatable members which are coupled together such that rotation of said first member causes rotation of said second member, said second member being coupled with said article conveying means and being movable with said carriage relative to said first rotatable member, said first and second rotatable members being coupled together such that when said first rotatable member is prevented from rotating, said second rotatable member rotates upon movement of said carriage.

3. Apparatus according to claim 1, wherein said first and second rotatable members are coupled together by a belt.

4. Apparatus according to claim 1, wherein said article conveying means comprises a pair of opposed track assemblies.

5. Apparatus according to claim 1, wherein said opposed surfaces are urged together under spring action.

* * * * *